US006895887B2

(12) United States Patent
Raiter

(10) Patent No.: US 6,895,887 B2
(45) Date of Patent: May 24, 2005

(54) GUNWALE MEMBER FOR A BOAT

(75) Inventor: Leon C. Raiter, Sartell, MN (US)

(73) Assignee: Crestliner, Inc., Little Falls, MN (US)

( * ) Notice: Subject to any disclaimer, the term of this patent is extended or adjusted under 35 U.S.C. 154(b) by 0 days.

(21) Appl. No.: 10/449,874

(22) Filed: May 30, 2003

(65) Prior Publication Data

US 2004/0237874 A1 Dec. 2, 2004

(51) Int. Cl.[7] ..... B63B 23/00
(52) U.S. Cl. ..... 114/367; 440/106
(58) Field of Search ..... 114/367, 343, 114/361; 440/106, 107, 108, 104, 105

(56) References Cited

U.S. PATENT DOCUMENTS 1,213,233 A * 1/1917 Morton ..... 440/2
1,587,710 A * 6/1926 Fiala ..... 114/360
2,794,191 A * 6/1957 Gaskouitz ..... 114/364
3,740,870 A * 6/1973 Acker et al. ..... 434/71
4,966,092 A * 10/1990 Illingworth ..... 114/356
5,157,858 A * 10/1992 Lockner et al. ..... 43/27.4
5,706,753 A * 1/1998 Menne et al. ..... 114/361
5,970,904 A 10/1999 Wellen et al.
6,474,851 B1 * 11/2002 Baley ..... 362/477

* cited by examiner

*Primary Examiner*—Frantz F. Jules
(74) *Attorney, Agent, or Firm*—Malin, Haley & DiMaggio, P.A.

(57) ABSTRACT

A gunwale for a boat. The gunwale can include an inner side and an outer side coupled at first ends to a top side forming a deck and at second ends to a bottom side. The gunwale can also include a first slot opening downwardly adjacent the inner side receiving a side panel of the boat, and a second slot opening downwardly adjacent the outer side receiving a hull of the boat. The outer side of the gunwale can also include a groove receiving a hook of a cover for the boat. A portion of the gunwale can also have an inner surface forming a closed channel and an outer surface forming an open channel through which lines can be run, and can also include a removable keeper coupled to the gunwale to at least partially close the open channel. The outer side of the gunwale can also include a laterally facing channel configured to receive a bumper.

28 Claims, 5 Drawing Sheets

GUNWALE MEMBER FOR A BOAT

TECHNICAL FIELD

The present invention relates generally to a gunwale system for a boat.

BACKGROUND

A gunwale (i.e., gunnel) of a boat is defined as the upper edge of the boat's side. A primary purpose of the gunwale is to stabilize and support the upper region of the hull of the boat and to maintain the shape (e.g., profile and planform) of the hull.

The gunwale can provide structural support for other components of the boat. For example, interior sidewalls of the boat can be coupled to the gunwale. A top surface of the gunwale can be used to form a top deck of the boat. Other components, such as lights and rails, can also be mounted to the gunwale.

Further, the gunwale can also be used to form a space through which lines such as electrical wires, mechanical cables, and hydraulic lines can be run. For example, lines can be run from a driver's console of the boat, through the gunwale, to a stern of the boat to interface with various components of the boat such as, for example, the motor, lighting, fish locator transducers, etc.

In aluminum boats, gunwales have been manufactured by extruding a single piece of metal to form a generally box shape. The box-shaped gunwale may include a slot to receive an upper edge of the hull of the boat and may also include an interior space through which lines can be run. The interior space is accessed by relatively small openings provided through the underside of the box-shaped gunwale. An example boat having this type of gunwale is the Crestliner 1750 Fish Hawk for model year 2002.

Gunwales of other configurations have also been used. For example, one type of multiple-piece gunwale includes a first extrusion that couples to the hull and a separate top deck piece, and a second extrusion that couples to the top deck piece and an interior wall of the boat. The gunwale defines a channel having an open bottom. Lines are routed through the channel and held in place within the channel by quick ties mounted within the channel. An example boat having this type of gunwale is the Crestliner Tournament Series 202 for model year 2002.

While gunwales currently perform various functions as noted above, it is desirable to increase the functionality and efficiency of gunwales.

SUMMARY

One aspect of the present invention relates to a gunwale system for a boat. In one embodiment, the gunwale system includes a gunwale member defining a channel, and a keeper member that couples to the gunwale member. By displacing the keeper member from the gunwale member, ready access is provided to the interior of the channel. When the keeper member is coupled to the gunwale member in a retaining position, the keeper member is adapted to prevent the lines routed through the channel from falling from the channel.

According to another aspect, the present invention relates to a one-piece extrusion for a boat including a groove for receiving a hook of a cover for the boat, a side panel slot for receiving a top end of a side panel of the boat, and a hull slot for receiving an upper edge of a hull of the boat.

According to yet another aspect, the present invention relates to a boat having gunwale including a portion of the gunwale having an inner surface defining a closed channel, and an outer surface defining an open channel through which lines can be run, the outer surface defining a groove configured to receive a hook of a cover for the boat.

According to another aspect, the present invention also relates to methods of providing a channel in a boat through which lines can be run.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

Figure 1:
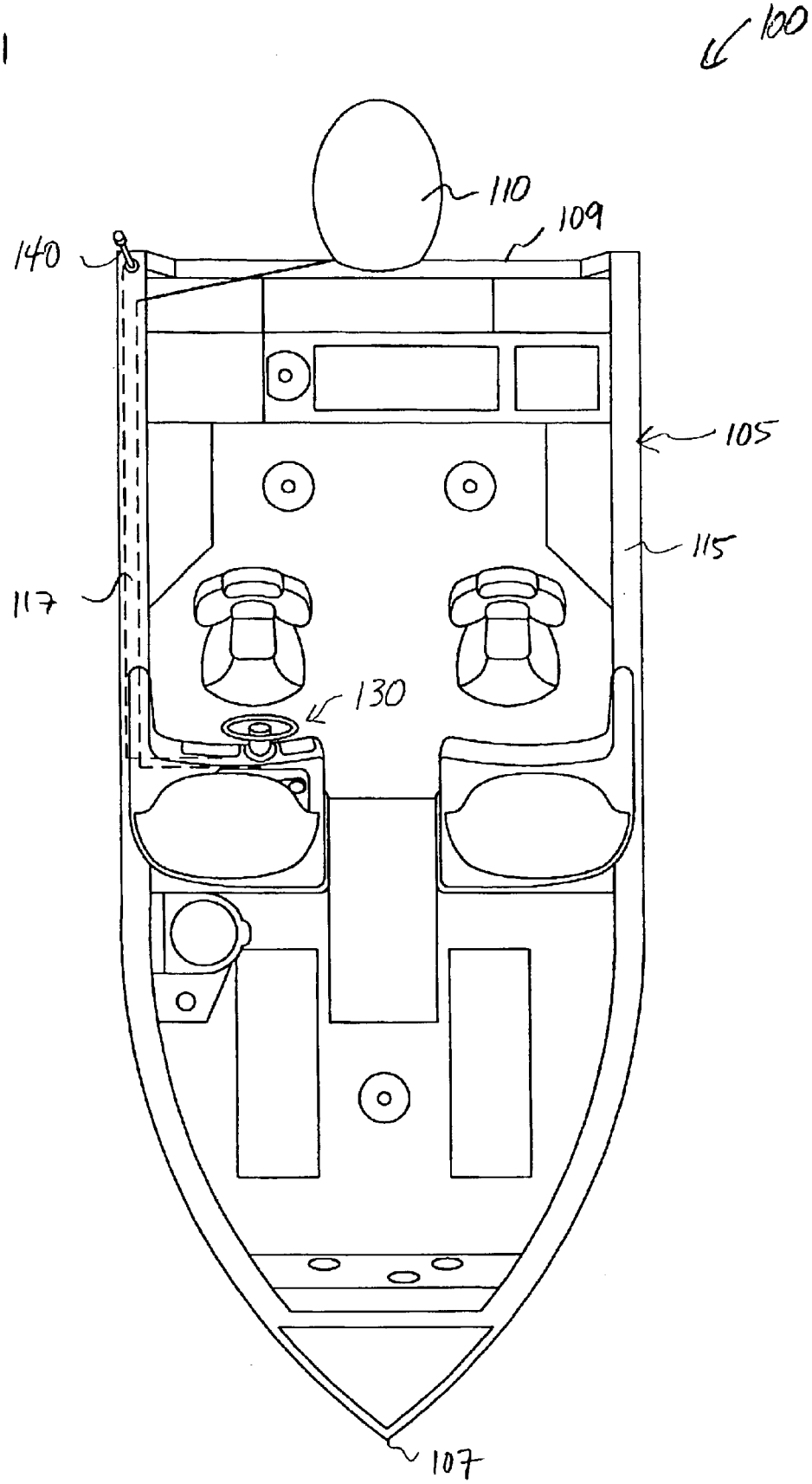
FIG. 1 is a top view of an example boat made in accordance with an aspect of the present invention.

While the invention is amenable to various modifications and alternative forms, the specifics there have been shown by way of example in the drawings and will be described in detail below. It is to be understood, however, that the intention is not to limit the invention to a particular embodiment. On the contrary, the intention is to cover all modifications, equivalents and alternatives falling within the scope of the invention as defined by the appended claims.

DETAILED DESCRIPTION

In the following detailed description, references are made to the accompanying drawings that depict various embodiments which are examples of how inventive concepts in accordance with the principles of the present disclosure may be practiced. It is to be understood that other embodiments may be utilized, and that structural and functional changes may be made without departing from the scope of the present invention.

One aspect of the present disclosure relates to a gunwale member for a boat. A gunwale member is generally coupled to a hull of a boat to provide structural support for the boat. In addition, another aspect of the present disclosure relates to various features provided on the gunwale member, such as a keeper member for holding lines within a channel defined at least in part by the gunwale member. In addition, the gunwale member can define one or more receiving portions to receive a side panel and/or a hull of the boat, and the gunwale member can define a groove configured to receive a hook of a cover fastening system, and can define a channel for receiving a bumper.

Referring now to FIG. 1, an example boat 100 is shown. The boat 100 generally includes a body 105 and a motor 110 to propel the body 105 through the water. The boat 100 also includes a gunwale system with gunwale members 115 and 117. The two gunwale members 115 and 117 are illustrated extending along both sides of the boat 100 from a bow 107 to a stem 109 of the boat. A plurality of lines 108 are illustrated running through the gunwale member 117 from a driver's console 130 of the boat 100 to the stem 109 of the boat.

A "line" is defined herein to mean any wire, cable, hose, or other structure for which it is desirable to run from one location in the boat to another location in the boat. For example and without limitation, lines can include shift cables, throttle cables, hydraulic steering and mechanical steering lines, electrical wires for an engine harness (e.g., ignition, gauges, tachometer, speedometer, oil voltage, trim, etc.) or lighting, fish locator lines, and water pressure hoses.

Specifically, in the illustrated embodiment electrical wires are run to a light 140 and hydraulic lines or mechanical cables are run to the motor 110 positioned at the stem 109. The lines 108 are used to control various components of the boat, such as to turn the light 140 on and off, steer, shift, throttle or start the motor 110, or to interface with other types of equipment such as fish locator transducers.

A detailed description is provided below of the various components comprising the gunwale members 115 and 117 and a method of using the members. The description below is provided by way of example only. Other configurations and methods of use are also possible.

I. The Gunwale Member

Figure 2:
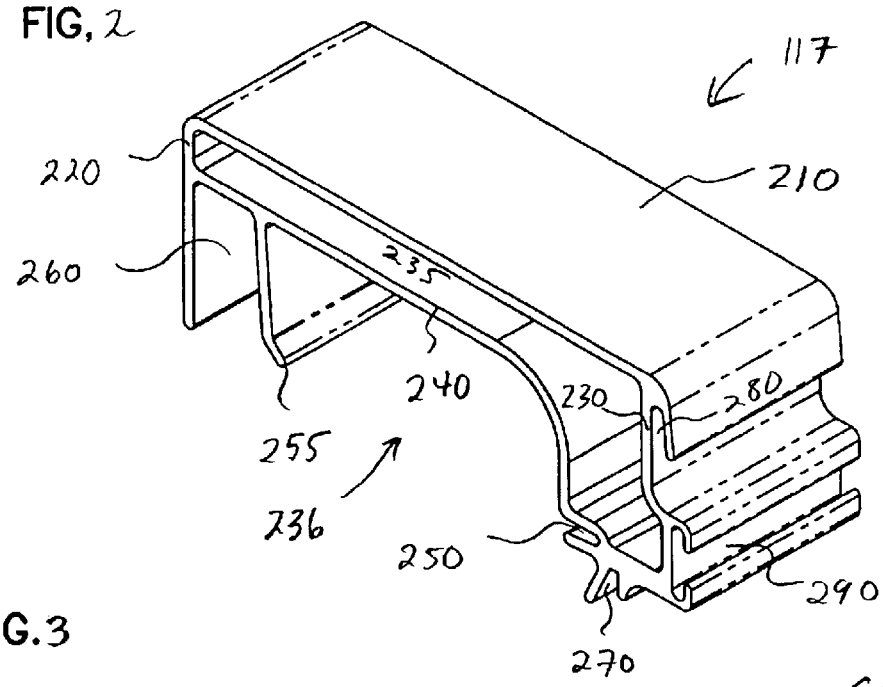
FIG. 2 is a perspective view of a portion of an example gunwale member made in accordance with an aspect of the present invention.
Figure 3:
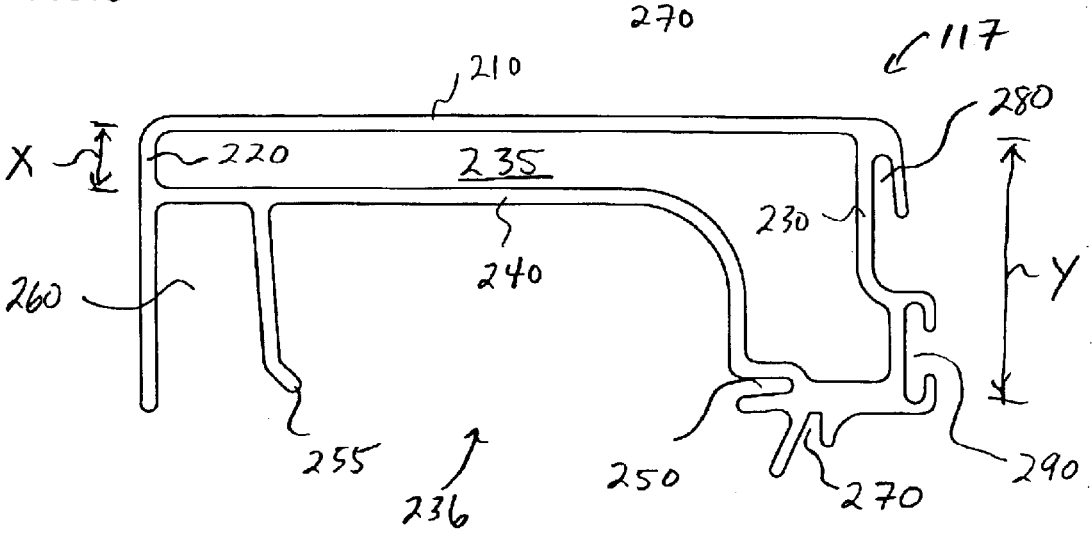
FIG. 3 is an end view of the gunwale member of FIG. 2.

Referring now to FIGS. 2 and 3, a portion of the example gunwale member 117 is shown. Although the gunwale member 117 is described below in detail, the gunwale member 115 can have a similar shape and can function in a like manner.

The gunwale member 117 includes a top side 210 defining a top deck, an inner side 220, an outer side 230, and a bottom side 240. As illustrated, the top 210, inner 220, outer 230, and bottom 240 sides are coupled together to form a closed interior channel 235. The closed channel 235 extends at least partially along the boat from the bow 107 to the stem 109 of the boat 100. In a preferred embodiment, the closed channel 235 extends from the bow 107 to the stem 109 of the boat 100.

As shown in FIG. 3, the closed channel 235 has an asymmetrical shape and includes a greater height adjacent the outer side 230 as compared to the inner side 220. For example, the channel 235 has a reduced height X at a location adjacent the inner side 220 and an increased height Y at a location adjacent the outer side 230. In one embodiment, the height Y is at least 1.5 times as large as the height X. In another embodiment, the height Y is at least 2 times as large as the height X.

In the preferred embodiment illustrated, the difference in the heights X and Y results in the gunwale member 117 defining an exterior channel 440 (i.e., a line routing channel) at a location beneath the bottom side 240. See, for example, FIG. 4. The region of the interior channel 235 having the reduced height X is positioned above the exterior channel 440. The region of the interior channel 235 having the increased height Y is located between the exterior channel 440 and the outer side 230 of the gunwale member 117. The exterior channel 440 is adapted to hold lines such as cables, hoses, wires, or hydraulic lines which can be routed into the exterior channel 440 through an open bottom 236 of the exterior channel. The open bottom 236 can be closed by a keeper member 400 (see FIG. 4) adapted for retaining the lines within the exterior channel. In one embodiment, the open bottom 236 of the channel 440 extends a majority of the length of the gunwale member 117. In a preferred embodiment, the open bottom 236 extends the entire length of the gunwale member 117.

The gunwale member 117 can preferably include various other features. For example, the gunwale member 117 defines a groove 250 and includes a projection 255. The groove 250 is configured to receive a first end of a keeper member 400, and the projection 255 is positioned so that a notch 420 defined in a second end of the keeper member 400 receives the projection 255, thereby allowing the keeper member to be removably coupled to the gunwale member 117 (see FIG. 4).

Figure 5:
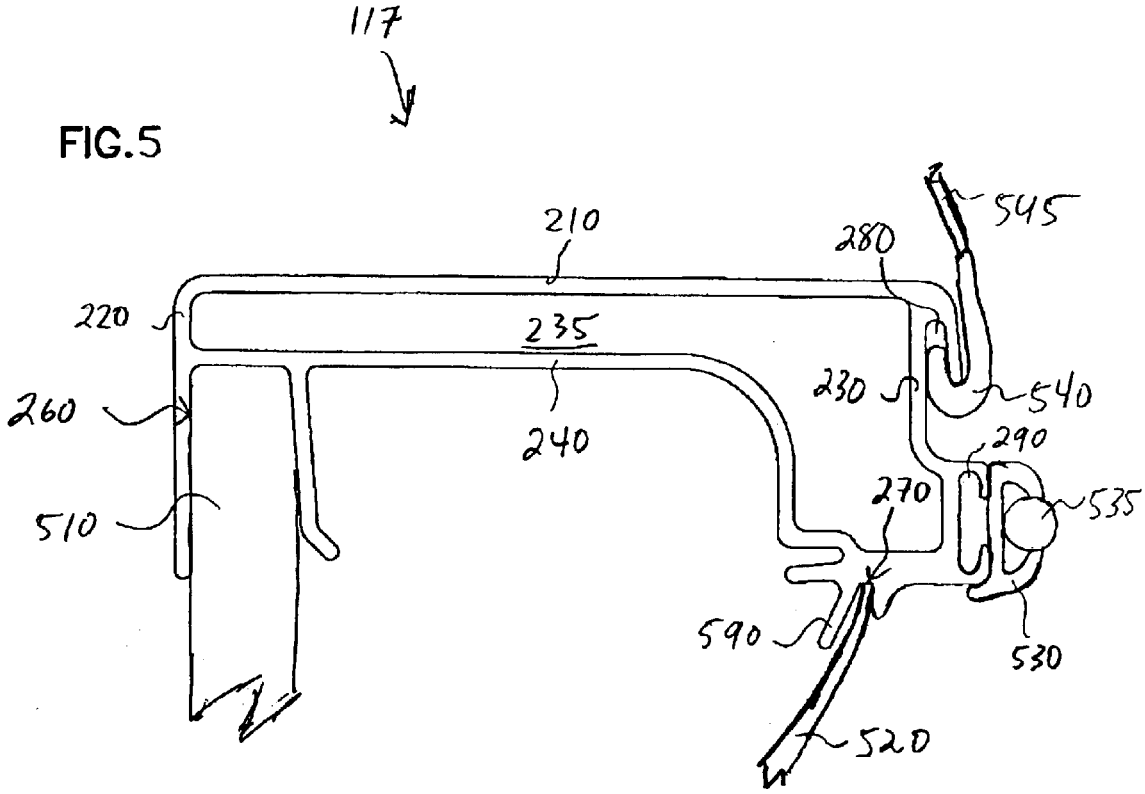
FIG. 5 is another end view of the gunwale member of FIG. 2 coupled to an example hull and side panel of a boat, as well as an example hook of a fastener covering system.

In addition, the example gunwale member 117 defines a first slot 260 adjacent the inner side 220 configured to receive a side panel of the boat 100, and the gunwale member 117 defines a second slot 270 opening downwardly adjacent the outer side 230 configured to receive a hull of the boat 100 (see FIG. 5). As used herein, the term "adjacent" means near or in the general vicinity thereof. Further, the gunwale member 117 defines a groove 280 configured to receive a hook of a cover for the boat 100, and a channel 290 configured to receive a bumper for the boat 100 (see also FIG. 5).

II. The Keeper Member

Figure 4:
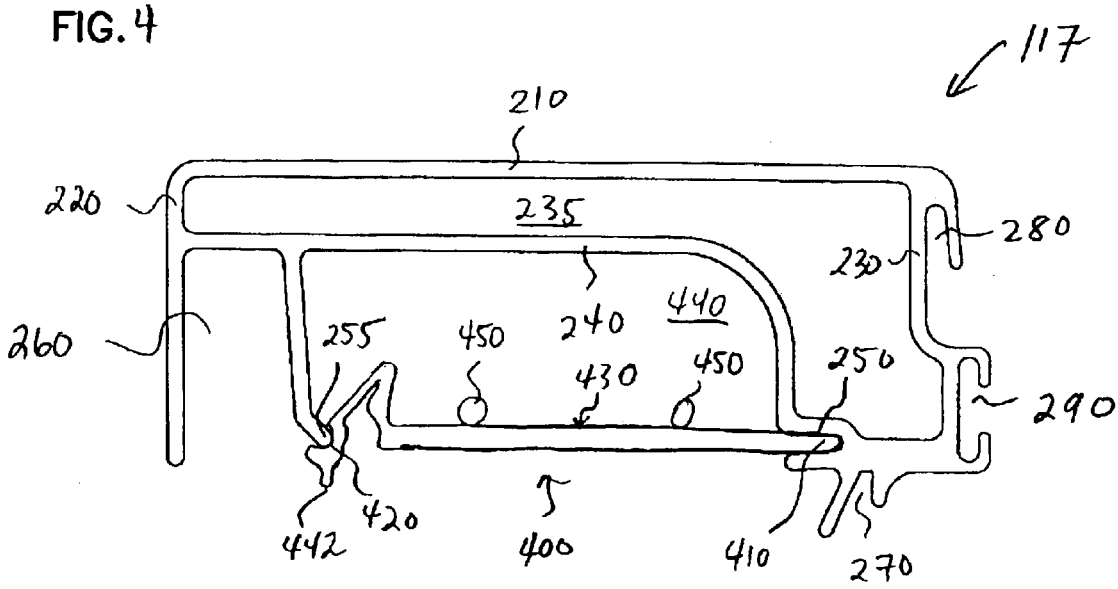
FIG. 4 is another end view of the gunwale member of FIG. 2 including an example keeper member made in accordance with an aspect of the present invention.

Referring now to FIG. 4, the example keeper member 400 is shown coupled to the gunwale member 117. The keeper member 400 includes a first end 410 sized to fit into the groove 250. At a second end of the keeper member 400, a notch 420 is configured to receive the projection 255 of the gunwale member 117. In this manner, the keeper 400 is removably coupled to the gunwale member 117.

A top side 430 of the keeper member 400 defines a surface upon which, and defines, along with the bottom side 240 of the gunwale member 117 the channel 440 through which lines 450 can be run.

In addition, the keeper member 400 can be removed from the gunwale member 117 by biasing a tab 442 of the keeper member 400 towards the first end 410 of the keeper, as described further below.

Although the example keeper member 400 illustrated herein is shown to be completely removable from the gunwale member 117, in alternative embodiments the keeper member 400 can be coupled to the gunwale 117 so that the keeper member 400 can be moved to allow access to the channel 440 without disconnecting or removing the keeper member 400 from the gunwale 117. For example, the first end 410 of the keeper member 400 can be pivotally coupled to the gunwale member 117 so that the keeper member can be pivoted out of the way to provide access to the channel 440 when desired. In other embodiments, the keeper member could be configured to slide out of the way to provide access to the channel 440.

Figure 6:
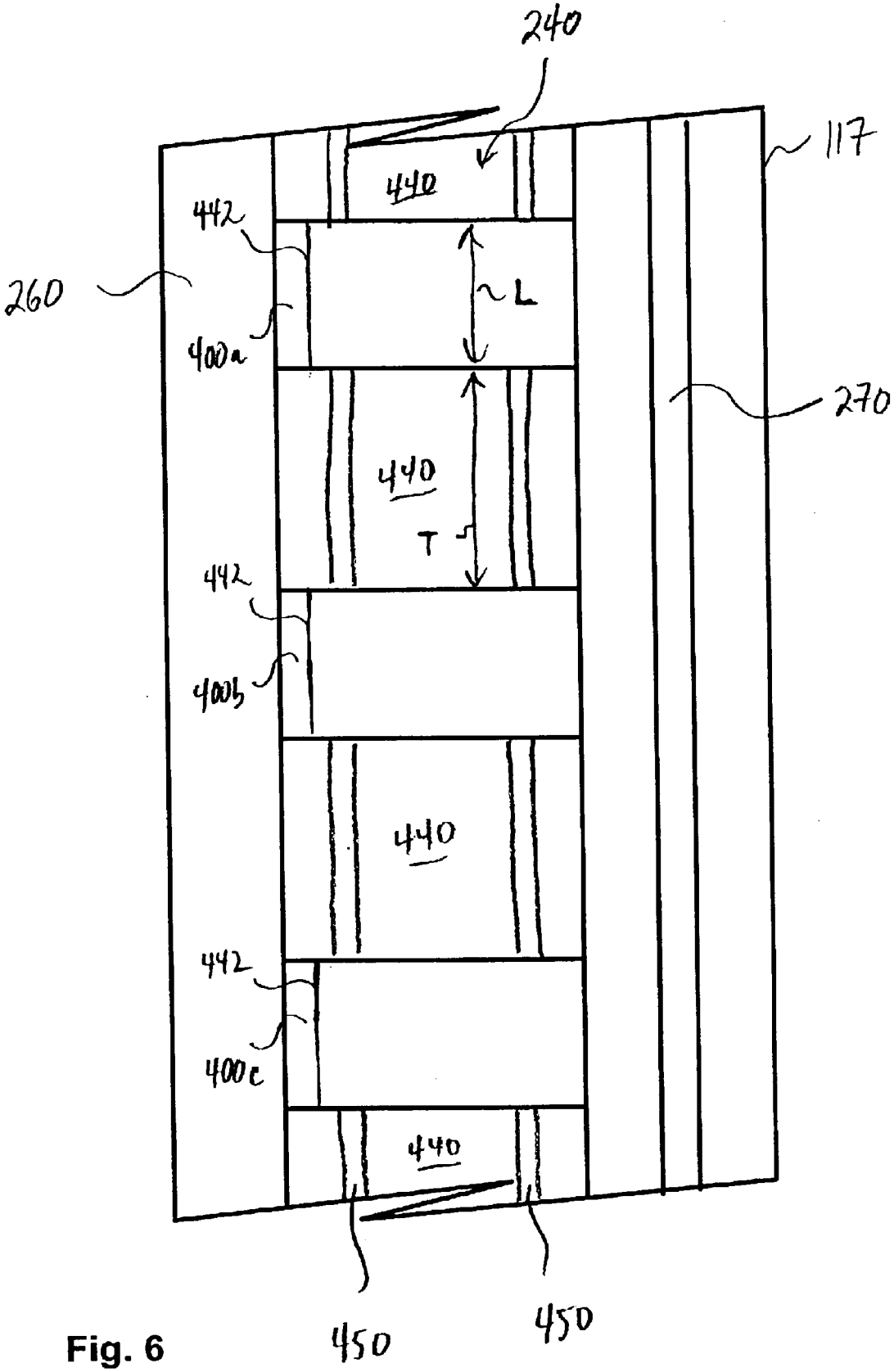
FIG. 6 is a bottom view of a portion of another example gunwale member including a plurality of example keeper members made in accordance with an aspect of the present invention.

In some embodiments, the keeper member 400 is run along the entire length of the gunwale member 117 to close the channel 440 along the entire length. In an alternative embodiment illustrated in FIG. 6, a plurality of keeper members 400*a*, 400*b*, and 400*c* are of a length L of preferably 5 inches, more preferably 3 inches. In other embodiments, the length L of each keeper members can vary.

The keeper members 400*a*, 400*b*, and 400*c* are spaced at intervals T along the gunwale member 117. Each keeper member 400*a*, 400*b*, and 400*c* can be individually removed from the gunwale member 117. In a preferred embodiment, the interval T is approximately 12 inches, more preferably 3–5 inches, even more preferably 3–4 inches. In alternative embodiments, the interval T between each keeper member can vary. It is desirable to provide a sufficient number of keeper members to maintain the lines in the channel 440 of the gunwale member 117.

In a preferred embodiment, the keeper member 400 is made of plastic. In alternative embodiments, the member 400 can also be made of metal or a like material.

III. The Side Panel, Hull, Cover System, and Bumper

Referring now to FIG. 5, the gunwale member 117 is illustrated with various other components. Specifically, the gunwale member 117 is illustrated with a side panel 510 and hull 520 of the boat 100, a bumper 530, and a hook 540 of a cover 545.

The side panel 510 of the boat 100 is received by the first slot 260 of the gunwale member 117. As described further below, the side panel 510 can be seating within the slot 260 and later removed, as desired. For example, the side panel 510 can be removed to provide access to the underside of the gunwale member 117. The side panel 510 forms an inner wall of the boat that extends from the gunwale member to near the floor of the boat.

The hull 520 is received within the second slot 270 and thereby coupled to the gunwale member 117. In a preferred embodiment, the hull 520 is welded to the gunwale member 117. A projection 590 of the gunwale member 117 extends from the gunwale member and engages the hull 520 as the hull extends to a pinnacle at the bow 107 of the boat 100.

The bumper 530 is positioned adjacent to or within the channel 290 of the gunwale member 117. In a preferred embodiment, the bumper 530 is made of plastic and includes a plastic rope insert 535. As illustrated, the bumper 530 preferably extends from the bow 107 to the stem 109 of the boat 100.

The hook 540 is part of a cover fastening system for the boat 100. The hook 540 engages the groove 280 of the gunwale member 117. A cover 545 extends from the hook 540 and over the boat 100. Preferably, a hook on the other side of the cover 545 engages a groove in the gunwale member 115 on an opposite side of the boat 100, and tension caused by stretching the cover 545 over the boat 100 maintains the hooks 540 in the grooves 280 and thereby retains the cover 545 in place.

IV. Method of Forming and Use

A method of forming and using the example gunwale system is as follows.

Initially, the gunwale members 115 and 117 are formed by extruding a metal to a desired length. In one preferred embodiment, each gunwale member is made of a unitary extruded construction. In other embodiments, each gunwale can be formed of multiple pieces. In one embodiment, the gunwale is made of aluminum, although other metals can also be used.

The members 115 and 117 are then curved to form the desired contours of the boat by a conventional metal bending process.

The hull 520 of the boat is then welded in the second slot 270 of the gunwale 117 to couple the hull to the gunwale member, with the top surface 210 of the gunwale member forming a deck of the boat. The structural integrity of the gunwale member maintains the hull in the desired shape. In the case of aluminum boats, the hull can include an aluminum plate having an upper edge positioned in the slot 270. The upper edge can be secured by conventional techniques such as welding or rivets. In one embodiment, the hull can include port and starboard side plates and port and starboard bottom plates. The side plates have upper edges secured within the slots 270 of the gunwale members 115, 117. Lower edges of the side plates can be coupled to the bottom plates by chine extrusions. The bottom plates can be coupled together by a keel extrusion.

Other hull configurations are also contemplated. For example, a two-piece hull having half-pieces with lower edges joined at the keel and upper edges coupled to the gunwales could be used. Further, in other embodiments, the hull can be coupled to the gunwales by means other than slots. For example, upper edging of the hull can be riveted to flanges of the gunwales.

Once in place, various lines can then be run through the gunwale member. In the illustrated embodiments, lines from the driver's console are run through the channel 440, and, once the lines are in place, the keeper member 400 can be coupled to the gunwale member to retain the lines in the channel. Specifically, the keeper member 400 can be removably coupled to the gunwale member by inserting the first end 410 of the keeper 400 into the slot 250 of the gunwale member, and then swinging the keeper upward so that the notch 420 receives the projection 255 of the gunwale member. The lines running through the gunwale member can be, for example, run to the stem of the boat and coupled to various components such as lights or the motor of the boat.

Various other components can also be coupled to the gunwale member. For example, the side panel 510 of the boat 100 can be received by the first slot 260 of the gunwale member 117 by sliding a top end of the side panel into the slot. Fasteners and brackets can be used to secure the bottom end of the panel in place.

The lines running through the channel 440 can be accessed once the keeper 400 and the side panel 510 are in place by first removing the side panel by sliding the upper end of the side panel out of the second slot 260 of the gunwale member. Next, the keeper 400 can be removed from the gunwale member by biasing the tab 442 of the keeper member 400 towards the first end 410 of the keeper to release the notch 420 from the projection 255 of the gunwale member. The first end 410 of the keeper can then be slid out of the groove 250 of the gunwale member to release the keeper from the gunwale member to provide access to the lines running through the channel 440.

In addition, the bumper 530 can be positioned adjacent to or within the channel 290 of the gunwale member 117.

Finally, the cover 545 for the boat 100 can be placed on the boat by placing the hook 540 of the cover into the groove 280 of the gunwale member. The cover 545 is then extended over the boat, and a hook on the opposite side of the cover is placed in a groove in the gunwale member on an opposite side of the boat 100, and tension caused by stretching the cover over the boat maintains the hooks in the grooves of the gunwale member and thereby retains the cover in place. Poles placed in a center region of the boat can be used to further tension the cover to hold it in place.

Having described aspects and example embodiments of the present invention, modifications and equivalents of the disclosed concepts may readily occur to one skilled in the art. For example, although the embodiments provided herein describe running lines from the driver's console, through the gunwale member, to the stem of the boat, it is also possible to run lines through the gunwale member to other parts of the boat, such as the bow of the boat. In another example, the closed channel formed by the gunwale member can be configured to extend along only a portion of the gunwale member.

It is intended that such modifications, as well as other modifications and equivalents, be included within the scope of the claims that are appended hereto.

What is claimed is:

1. A gunwale system for a boat, comprising:

a gunwale member defining a channel; and a keeper member that couples to the gunwale member, the gunwale and keeper members at least partially enclosing the channel so that at least one line can run therethrough, and the keeper member being moveable relative to the gunwale member to provide access to the channel; and wherein the gunwale member further comprises a first receiving portion to accept one end of a side panel and a second receiving portion to accept one end of a hull.

2. The system of claim 1, wherein the keeper member includes a plurality of separate portions, each separate portion extending along a part of a length of the channel and being separately moveable relative to the gunwale member to provide access to the channel.

3. The system of claim 1, wherein the gunwale member further comprises a groove configured to receive a hook of a cover for the boat.

4. The system of claim 1, wherein the gunwale member further defines a laterally facing channel configured to receive a bumper.

5. The system of claim 1, wherein the gunwale member is an extrusion.

6. The system of claim 1, wherein the gunwale member defines a groove configured to receive a first end of the keeper member and comprises a projection positioned so that a notch defined in a second end of the keeper receives the projection, thereby removably coupling the keeper member to the gunwale member.

7. The system of claim 6, wherein the keeper member further comprises a resilient tab positioned at the second end of the keeper member to allow the keeper member to be uncoupled from the gunwale member.

8. The system of claim 1, wherein the gunwale member includes three sides defining a portion of the channel, and wherein the keeper member includes another side defining a remaining portion of the channel.

9. The system of claim 8, wherein the keeper member is positioned as a bottom of the channel.

10. A boat including a gunwale extrusion and a keeper, the boat comprising:

a channel defined by the gunwale extrusion and the keeper, wherein the channel is sized is received at least one line, and wherein the keeper is coupled to the gunwale extrusion along at least a portion of the gunwale extrusion;

a hull coupled to the gunwale extrusion; and a side panel coupled to the gunwale extrusion; and wherein the keeper includes a plurality of separate portions, each separate portion extending along a part of a length of the channel and being separately moveable relative to the gunwale member to provide access to the channel.

11. The boat of claim 10, wherein the gunwale extrusion further comprises a groove configured to receive a hook of a cover for the boat.

12. The boat of claim 10, wherein the gunwale extrusion further defines a laterally facing channel configured to received a bumper.

13. The boat of claim 10, wherein the gunwale extrusion defines a groove configured to receive a first end of the keeper, and comprises a projection positioned so that a notch defined in a second end of the keeper receives the projection, thereby removably coupling the keeper to the gunwale extrusion.

14. The boat of claim 13, wherein the keeper further comprises a resilient tab positioned at the second end of the keeper to allow the keeper to be uncoupled from the gunwale extrusion.

15. A gunwale for a boat, the gunwale comprising:

a gunwale member that defines a closed interior channel along at least a portion of a length of the gunwale member;

the gunwale member including a top side defining a top deck and a bottom side defining an exterior channel having an open bottom;

the top and bottom sides of the gunwale member extending between inner and outer sides;

the interior channel having a first height at a location above the exterior channel and a second height at a location between the exterior channel and the outer side of the gunwale member, the second height being larger than the first height.

16. The gunwale of claim 15, wherein the gunwale member comprises a unitary extrusion.

17. The gunwale of claim 16, wherein the unitary extrusion includes aluminum.

18. The gunwale of claim 15, further comprising a keeper that mounts adjacent the open bottom of the exterior channel for holding lines within the exterior channel, the keeper being moveable relative to the gunwale member to provide access to the exterior channel.

19. The gunwale of claim 18, wherein the keeper is removable from the gunwale member.

20. The gunwale member of claim 18, wherein the gunwale member defines a groove for receiving an edge of the removable keeper.

21. The gunwale of claim 15, wherein the gunwale member defines a hull receiving slot adjacent the outer side.

22. The gunwale of claim 15, wherein the gunwale member defines a bumper receiving slot adjacent the outer side.

23. The gunwale of claim 15, wherein the gunwale member defines a cover hook receiving slot adjacent the outer side.

24. The gunwale of claim 15, wherein the gunwale member defines a side panel receiving slot adjacent the inner side.

25. The gunwale of claim 15, further comprising:

a keeper that mounts adjacent the open bottom of the exterior channel;

a hull receiving slot defined by the gunwale member adjacent the outer side;

a panel receiving slot defined by the gunwale member adjacent the inner side;

a bumper slot defined by the gunwale member adjacent the outer side; and a cover hook receiving slot defined by the gunwale member adjacent the outer side.

26. The gunwale of claim 25, wherein the gunwale member has a unitary extruded construction.

27. The gunwale of claim 15, wherein the second height is at least 1.5 times as large as the first height.

28. The gunwale of claim 15, wherein the second height is at least 2 times as large as the first height.

* * * * *